US006985028B2

(12) United States Patent
Lee et al.

(10) Patent No.: US 6,985,028 B2
(45) Date of Patent: Jan. 10, 2006

(54) PROGRAMMABLE LINEAR-IN-DB OR LINEAR BIAS CURRENT SOURCE AND METHODS TO IMPLEMENT CURRENT REDUCTION IN A PA DRIVER WITH BUILT-IN CURRENT STEERING VGA

(75) Inventors: See Taur Lee, Richardson, TX (US); Abdellatif Bellaouar, Richardson, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/689,311

(22) Filed: Oct. 20, 2003

(65) Prior Publication Data

US 2004/0189375 A1 Sep. 30, 2004

Related U.S. Application Data

(60) Provisional application No. 60/458,499, filed on Mar. 28, 2003.

(51) Int. Cl.
*G05F 3/02* (2006.01)

(52) U.S. Cl. ..... 327/543; 327/538; 323/315

(58) Field of Classification Search ..... 327/538, 327/539, 540, 541, 543; 323/313, 315
See application file for complete search history.

(56) References Cited

U.S. PATENT DOCUMENTS

| | | | | |
|---|---|---|---|---|
| 5,034,626 | A * | 7/1991 | Pirez et al. | 327/542 |
| 5,057,792 | A * | 10/1991 | Gay | 323/315 |
| 5,568,082 | A * | 10/1996 | Hedberg | 327/437 |
| 6,107,868 | A * | 8/2000 | Diniz et al. | 327/543 |
| 6,181,121 | B1 * | 1/2001 | Kirkland et al. | 323/313 |
| 6,201,436 | B1 * | 3/2001 | Hur et al. | 327/543 |
| 6,407,620 | B1 * | 6/2002 | Hirayama | 327/538 |
| 2004/0036460 | A1 * | 2/2004 | Chatal | 323/313 |
| 2004/0155700 | A1 * | 8/2004 | Gower et al. | 327/543 |

* cited by examiner

*Primary Examiner*—Terry D. Cunningham
(74) *Attorney, Agent, or Firm*—Ronald O. Neerings; Wade James Brady, III; Frederick J. Telecky, Jr.

(57) ABSTRACT

Programmable linear-in-dB or linear bias current source with respect to an input voltage is provided. The linear-in-dB or linear bias current may be clipped at a minimum current level, a maximum current level, or a combination thereof. Preferably, the minimum and maximum current levels are determined by the use of one or more constant current sources. The constant current sources limit the amount of voltage applied to the gates of one or more transistors, which in turn control the output current. The use of the circuit may be used to generate linear or reverse-linear current levels with respect to an input voltage. The output of the current generator may be used as an input to a power-amplifier driver, for example.

18 Claims, 4 Drawing Sheets

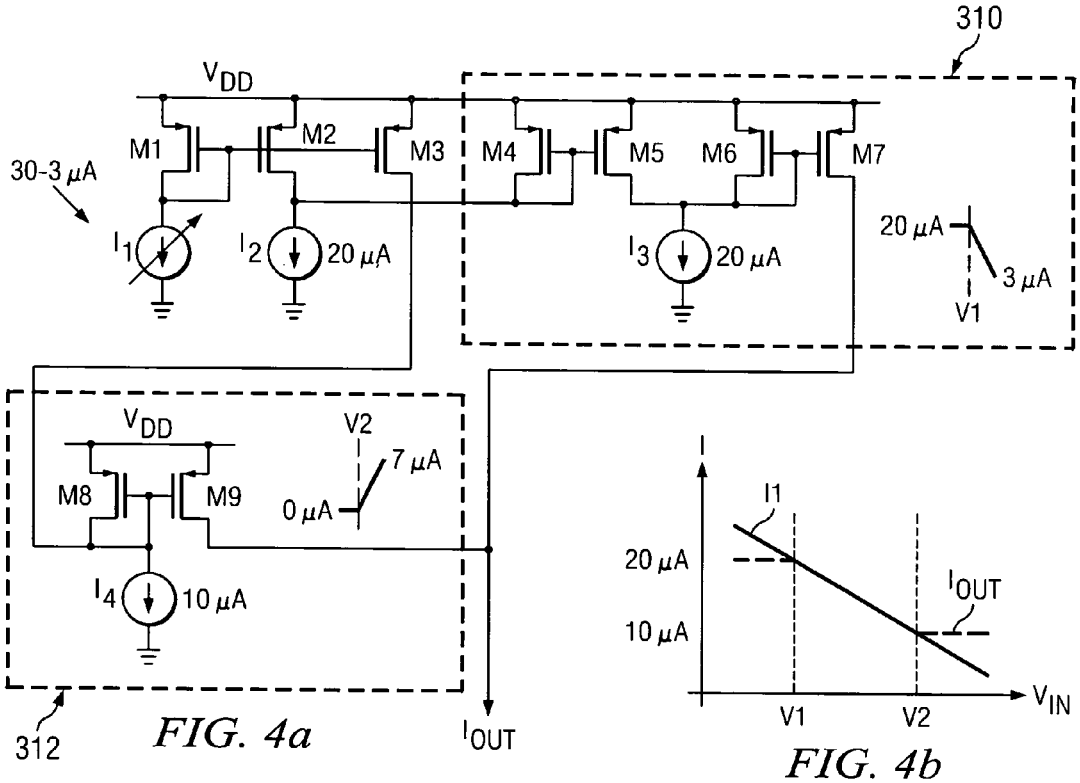
FIG. 4a
FIG. 4b
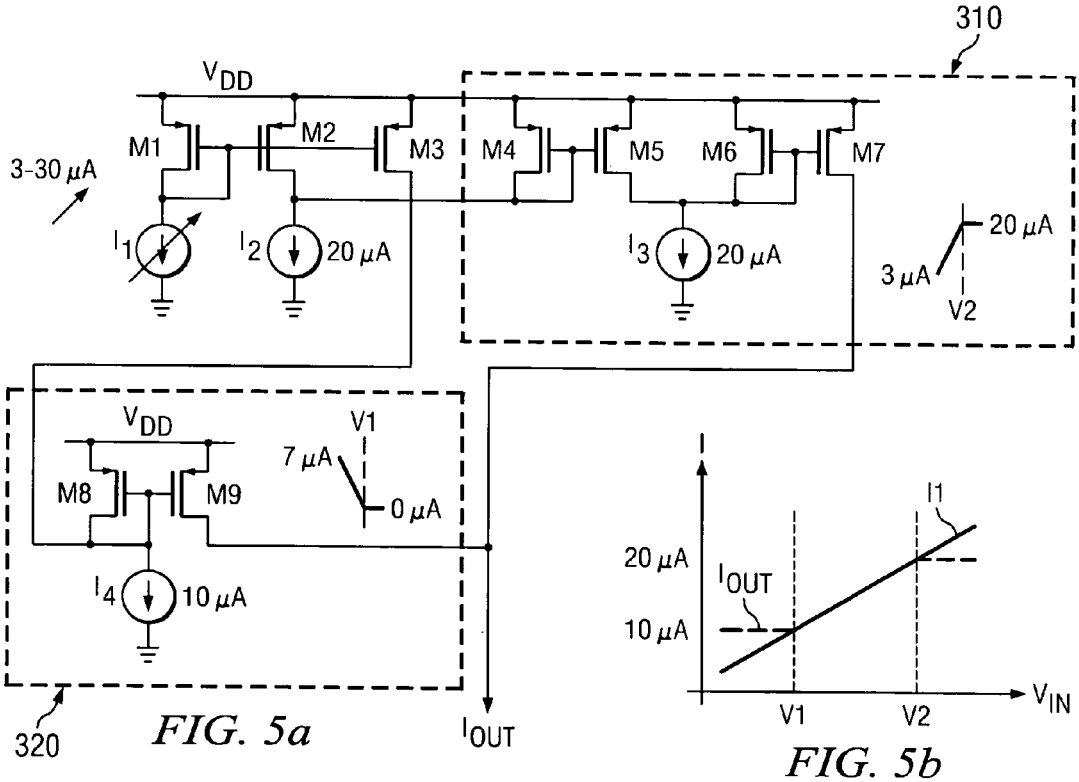
FIG. 5a
FIG. 5b

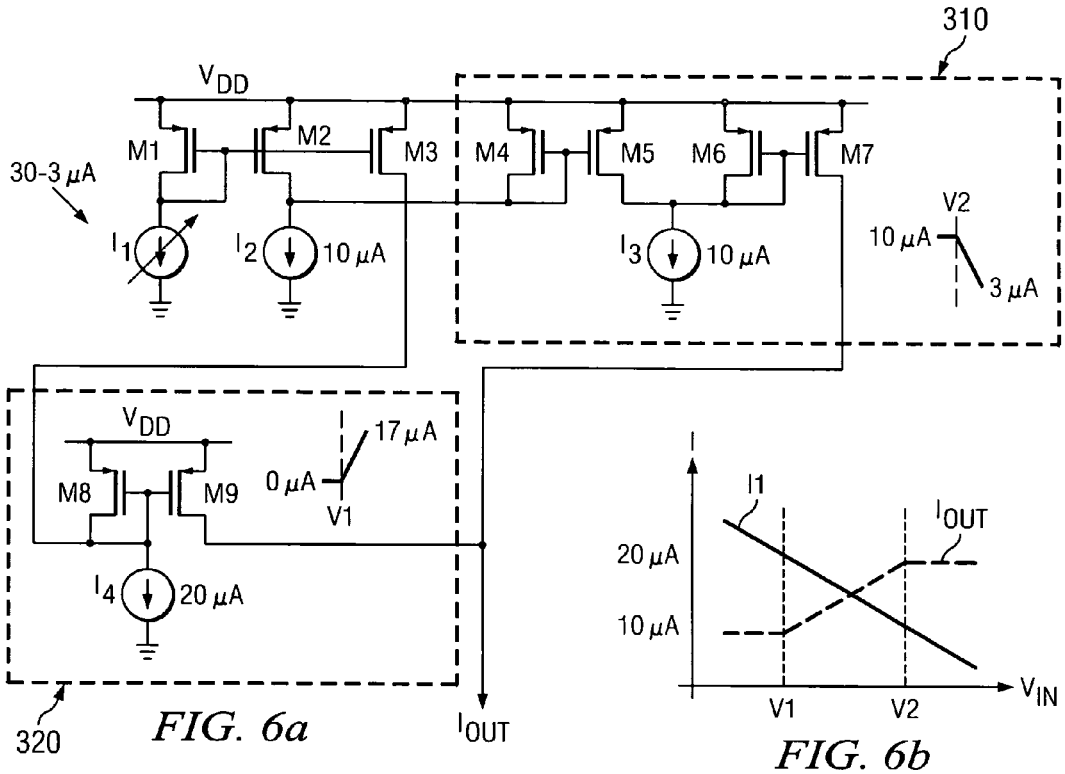
FIG. 6a
FIG. 6b
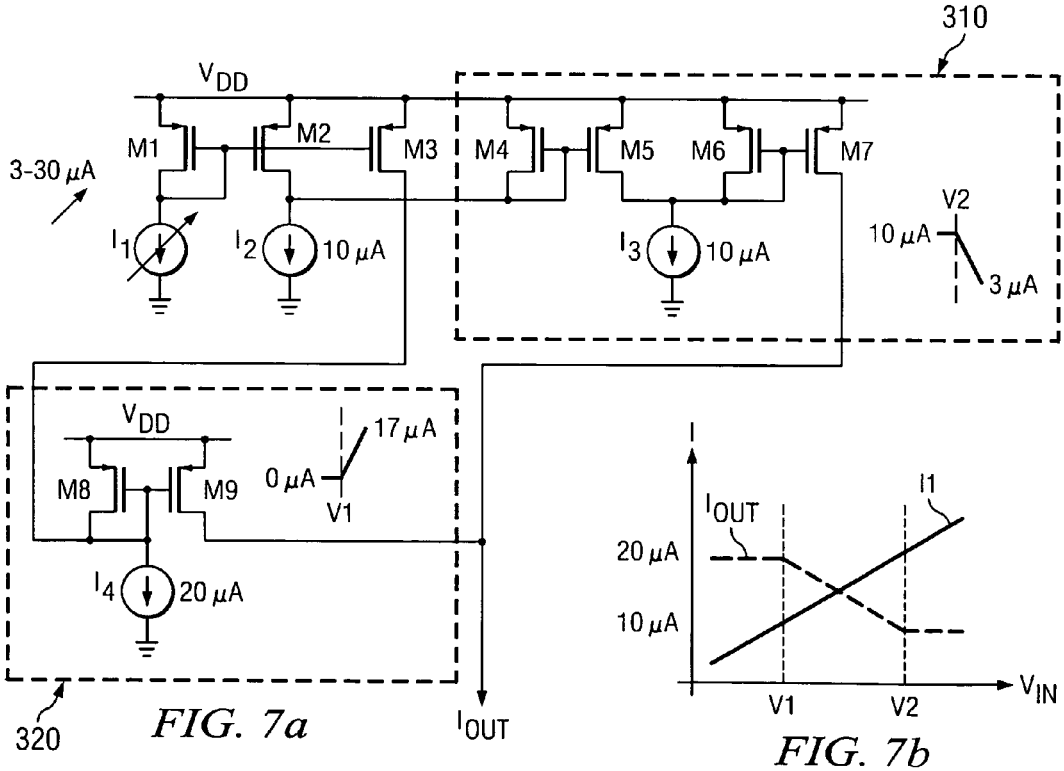
FIG. 7a
FIG. 7b

PROGRAMMABLE LINEAR-IN-DB OR LINEAR BIAS CURRENT SOURCE AND METHODS TO IMPLEMENT CURRENT REDUCTION IN A PA DRIVER WITH BUILT-IN CURRENT STEERING VGA

This application claims the benefit of U.S. Provisional Application No. 60/458,499, filed on Mar. 28, 2003, entitled Programmable Linear-in-dB or Linear Bias Current Source and Methods to Implement Current Reduction in a PA Driver with Built-In Current Steering VGA, which application is hereby incorporated herein by reference.

TECHNICAL FIELD

The present invention relates to the field of electronic circuits, and more specifically, to programmable linear-in-dB or linear bias current source with respect to an input voltage with the capability of having a constant minimum and/or maximum current at certain input voltages and different clipping maximum or minimum currents.

BACKGROUND

Many electronic components, such as amplifiers for wireless communications receivers and transmitters, contain signal amplifiers to enhance the performance of the systems. These electronic components typically utilize a bias current source circuit to apply a bias or a gain to the signal.

Generally, the current source may be biased by a constant gain, a linear gain, or a linear-in-dB gain. A constant gain simply amplifies the current source by a constant gain. A linear gain is biased linearly as the received signal varies. A linear-in-dB gain applies an exponential amplifier gain in response to a linear change in the received signal.

For example, FIG. 1 is a plot that shows a linearly changing output current source with respect to the input voltage. The horizontal axis represents the input voltage $V_{in}$ of the received signal, and the vertical axis represents the output current $I_{out}$. As the input voltage $V_{in}$ increases, the output current $I_{out}$ increases linearly with respect to the input voltage $V_{in}$.

FIG. 2 is a circuit diagram that illustrates a circuit 200 that linearly biases a current source with respect to an input voltage as illustrated in FIG. 1. The circuit 200 has a control amplifier 210, transistors M1, M2, and M3, and resistor R1. Control amplifier 210 has inputs $V_{in}$ and a feedback line. The output of the control amplifier 210 is electrically coupled to the gate of transistor M3. The source of transistor M3 is electrically coupled to the feedback line of control amplifier 210 and resistor R1 to ground. The drain of transistor M3 is electrically coupled to $V_{dd}$ through transistor M1. The gates of transistors M1 and M2 are electrically coupled to the drain of transistor M3. The drain of transistor M2 is electrically coupled to the output current $I_{out}$.

While this circuit clips the output current $I_{out}$ at predetermined input voltages due to circuit limitations, the circuit illustrated in FIG. 2 does not have the ability to clip or limit the output current $I_{out}$ at different desired levels. Furthermore, the circuit illustrated in FIG. 2 cannot provide a linear-in-dB current source with respect to the input voltage.

Many applications, however, would benefit from a linear-in-dB gain amplification or current clipping. For example, a power amplifier (PA) driver with built-in current steering variable gain amplifier (VGA) utilizes a dumping transistor to vary the output current as the power levels change. At maximum output power, the current in the dumping transistor is almost zero. However, when the output power is decreasing, the current in the dumping transistor increases until all the current is steered to the dumping transistor. Consequently, power is lost or wasted at low output power levels. Because a typical PA driver consumes a large portion of current consumption from a chip, it is desirable to reduce the amount of current that is wasted through the dumping transistor.

Therefore, there is a need to bias the current to the PA driver with the built-in current steering VGA scaled linearly-in-dB to a predetermined level when the output power of the PA driver is reduced. Furthermore, there is a need to generate a linear output current with respect to the input voltage with maximum and/or minimum clipping levels.

SUMMARY OF THE INVENTION

The problems and needs outlined above are addressed by embodiments of the present invention. Embodiments of the present invention relate to a method and an apparatus to generate a bias current source, which may change either linearly or linear-in-dB with respect to an input voltage, and having the capability of clipping the output current at different input voltages. The bias current can have either a constant maximum or minimum output current level.

In accordance with one aspect of the present invention, the current generator accepts an input voltage and outputs a current limited by one or two current levels, such as limiting a current to a minimum level and a maximum level. In a preferred embodiment, the current is limited by one or more current sources electrically coupled to the gate of one or more transistors. Generally, the current source limits the amount of current allowed to flow through a line coupled to the gates of the transistors. Therefore, the current allowed to flow through the transistors is limited to the current source. By using transistors and fixed current sources to limit the current, the relationship between the input voltage and the output current can be designed to fulfill the requirements of a given application, such as linear, reverse linear, clipped at a maximum, clipped at a minimum, or a combination thereof.

In another embodiment of the present invention, the current sources are programmable under software control. This method provides an additional level of flexibility by allowing the behavior of a circuit to be modified dynamically.

In yet another embodiment of the present invention, the current generator provides a linear-in-dB current with respect to an input voltage. The output of the current generator may be added to an offset current and fed into a power amplifier driver, which in turn may drive a power amplifier.

Embodiments of the present invention can be used to achieve certain functions in an integrated circuit and to save power for certain applications. One of the application examples that can be benefited with this present invention is a power amplifier driver with built-in current steering variable gain amplifier, which is commonly used in a transmitter and other devices. At minimum output power, the current in the dumping transistor is substantially reduced.

BRIEF DESCRIPTION OF THE DRAWINGS

The above features of the present invention will be more clearly understood from consideration of the following descriptions in connection with accompanying drawings in which:

FIG. 4*a* is a circuit diagram as shown in FIG. 3*b* with illustrative values that may be used to obtain a linear current to input voltage curve wherein the output current decreases linearly as the input voltage increases with current clipping at a minimum and maximum in accordance with one embodiment of the present invention;

FIG. 4*b* is a plot of an output current obtainable from the circuit diagram illustrated in FIG. 4*a;*

FIG. 5*a* is a circuit diagram as shown in FIG. 3*b* with illustrative values that may be used to obtain a linear current to input voltage curve wherein the output current increases linearly as the input voltage increases with current clipping at a minimum and maximum in accordance with one embodiment of the present invention;

FIG. 5*b* is a plot of an output current obtainable from the circuit diagram illustrated in FIG. 5*a;*

FIG. 6*a* is a circuit diagram as shown in FIG. 3*b* with illustrative values that may be used to obtain a linear current to input voltage curve wherein the output current increases linearly as the input voltage increases with current clipping at a minimum and maximum in accordance with one embodiment of the present invention;

FIG. 6*b* is a plot of an output current obtainable from the circuit diagram illustrated in FIG. 6*a;*

FIG. 7*a* is a circuit diagram as shown in FIG. 3*b* with illustrative values that may be used to obtain a linear current to input voltage curve wherein the output current decreases linearly as the input voltage increases with current clipping at a minimum and maximum in accordance with one embodiment of the present invention;

FIG. 7*b* is a plot of an output current obtainable from the circuit diagram illustrated in FIG. 7*a*.

DETAILED DESCRIPTION

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

Figure 1:
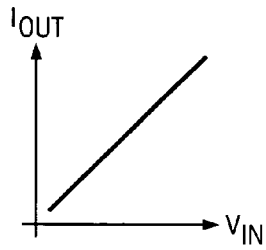
FIG. 1 (PRIOR ART)
FIG. 1 is a plot of output current versus input voltage in a prior art circuit.
Figure 2:
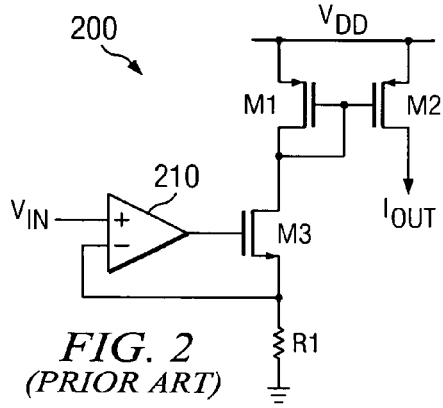
FIG. 2 (PRIOR ART)
FIG. 2 is a circuit diagram of the prior art that may be used to generate the current plotted in FIG. 1.
Figure 3A:
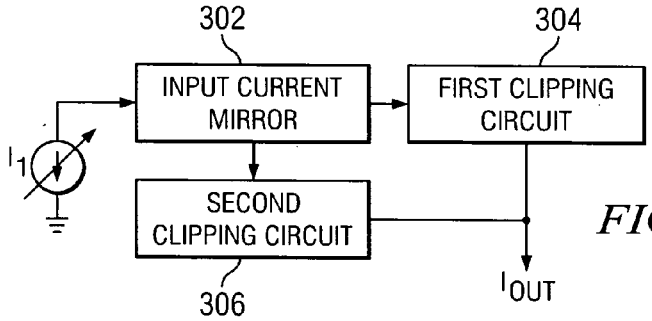
FIG. 3*a* is a block diagram of a current generator in accordance with one embodiment of the present invention.

FIG. 3*a* shows a block diagram that provides a current clipping circuit in accordance with one embodiment of the present invention. The block diagram includes an input current source I1 that is preferably generated via a voltage-to-current converter (not shown). The input current source I1 may have a linear relationship with the input voltage or a reverse-linear relationship with the voltage. The input current source I1 is electrically coupled to an input current mirror 302. The input mirror 302 provides a current that is substantially equivalent to the input current source I1 limited to a maximum current. The limited input current source is provided to a first clipping circuit 304 and a second clipping circuit 306. Each of the first clipping circuit 304 and the second clipping circuit 306 limits the input current source I1 to a minimum or a maximum. The current limited by the first clipping circuit 304 and the second clipping circuit 306 is summed to create the output current $I_{out}$.

Figure 3B:
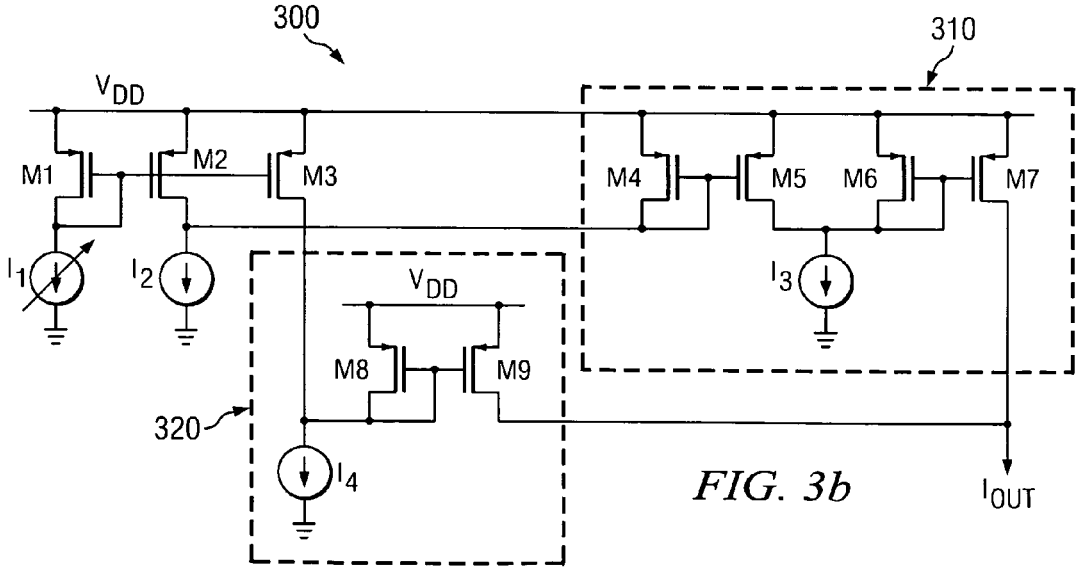
FIG. 3*b* is a circuit diagram of a current generator in accordance with one embodiment of the present invention.

FIG. 3*b* shows a bias current circuit 300 which performs current manipulation in accordance with one embodiment of the present invention. In particular, FIG. 3*b* illustrates one circuit that may be utilized to design the block diagram illustrated in FIG. 3*a* in accordance with one embodiment of the present invention. Other circuits, however, may be used in accordance with the present invention.

The first circuit 300 includes a current source I1 that represents a varying input current. The current source I1 is connected to the gates of transistors M1, M2, and M3, and the drain of transistor M1. The drain of transistor M2 is connected to a constant current source I2 and the drain of transistor M4. The drain of transistor M3 is connected to a constant current source I4. The sources of transistors M1, M2, and M3 are connected to a direct-current (DC) power supply $V_{dd}$. In this configuration, transistors M1, M2, and M3 mirror the current source I1.

The drain of transistor M2 is input to a first current clipping circuit 310 having transistors M4, M5, M6, and M7, each having the source connected to the constant DC voltage supply $V_{dd}$. Transistor M4 has its drain connected to the drain of transistor M2 and the gates of transistors M4 and M5. The drains of transistors M5 and M6 are connected to a constant current source I3. The drain of transistor M6 is further connected to the gates of transistors M6 and M7.

The drain of transistor M3 is input to a second current clipping circuit 320 having transistors M8 and M9. The sources of transistors M8 and M9 are connected to the constant DC voltage supply $V_{dd}$. The drain of transistor M8 is connected to the drain of transistor M3, the constant current source I4, and the gates of transistors M8 and M9. The drain of transistor M9 is connected to the drain of M7, wherein the sum of the current represents the output current $I_{out}$.

As one of ordinary skill in the art will appreciate, current sources I2 and I3 determine a first current clipping level, and current source I4 determines a second current clipping level, wherein the value of the respective current source represents the clipped current level. Preferably, the constant current sources I2, I3, and I4 are programmable current sources in which the amount of current may be varied for a particular application or scenario.

FIGS. 4*a*–7*b* illustrate the operation of the bias current circuit 300 (FIG. 3*b*) and the current source versus input voltage curves that may be achieved by the bias current circuit 300 in accordance with embodiments of the present invention. In each of the FIGS. 4*a*, 5*a*, 6*a*, and 7*a*, the bias current circuit 300 of FIG. 3*b* is shown with representative values for the current sources. The current-to-voltage curves are also shown for specific locations of the circuit. FIGS. 4*b*, 5*b*, 6*b*, and 7*b* illustrate the current source versus voltage curves resulting from the operation of the circuits illustrated in FIGS. 4*a*, 5*a*, 6*a*, and 7*a*, respectively. In each of the FIGS. 4*b*, 5*b*, 6*b*, and 7*b*, the horizontal axis represents the input voltage, wherein $V_1$ represents a lower voltage level below which the output current $I_{out}$ is to be limited and $V_2$ represents an upper level above which the output current $I_{out}$ is to be limited. Furthermore, the input current I1 is indicated by a solid line, and the output current $I_{out}$ is indicated by a dotted line. As will be shown below, the embodiment discussed above can generate a decreasing or increasing output current and may clip the output current at either one or both of the desired input voltages $V_1$ and $V_2$.

FIGS. 4*a* and 4*b* illustrate the operation of the circuit described above with reference to FIG. 3*b* in accordance with one embodiment of the present invention in which the input current source I1 decreases as the input voltage increases. For illustrative purposes only, the operation will be discussed wherein the current source I1 is assumed to be decreasing from about 30 μA to and 3 μA, current sources I2, I3 and I4 are constant and are set equaled to 20 μA, 20 μA and 10 μA, respectively. Preferably, current source I1 is the input current generated by a voltage-to-current converter (not shown) as is known in the art.

Transistors M1, M2 and M3 mirror the input current source I1. The sum of the current flowing through transistors M2 and M4 will be substantially equivalent to constant current source I2, which in this case is set at 20 μA. Thus, when the current source I1 is between 20 μA and 30 μA, the current flowing through transistor M2 will approach 20 μA (the maximum current allowed by constant current source I2). Furthermore, because the output of transistor M2 will be about 20 μA and, the sum of the output of transistor M2 and M4 will be a maximum of 20 μA, the output of transistor M4 will be close to 0 μA. As the current flowing through transistor M4 approaches 0 μA, the current flowing through M5 also approaches zero, which will cause the current flowing through transistor M6 to approach the constant current source I3, i.e., 20 μA. When transistor M6 approaches the constant current source I3, transistor M7 is enabled to allow current to flow therethrough, but at no greater level than the constant current source I3, i.e., 20 μA in this example.

The second current clipping circuit 320 is effectively disabled when the input current I1 is greater than the constant current source I4, which acts as the minimum clipping level in this case. When the input current I1 is above the constant current source I4, the current flowing through transistor M3 will approach the level of the constant current source I4, i.e., 10 μA in this example. Consequently, the current flowing through transistor M8 will be about 0 μA, thereby disabling transistor M9.

Accordingly, when the input current source I1 is greater than the constant current sources I2 and I3, the output of the first current clipping circuit 310 is about equal to the constant current source I2 and I3, and the output of the second current clipping circuit is about 0 μA. Thus, the output current $I_{out}$ is clipped at the maximum current as defined by I2 and I3.

When the input current source I1 drops below the minimum current, e.g., 3 μA, of the constant current level I4, i.e., 10 μA in this case, the current flowing through transistors M7 will be approximately equal to the input current source I1. The current flowing through transistor M8, however, increases because the sum of the current flowing through transistors M3 and M8 will be substantially equal to the constant current source I4. Consequently, when the current flowing through transistor M3 is about 3 μA, the current flowing through transistors M8 and M9 will be about 7 μA. In this situation, the output current lout is the sum of the current flowing through transistors M7 and M9, which is about 10 μA, or the value set by constant current source I4.

When the input current is between the minimum current level (i.e., 10 μA) and the maximum current level (i.e., 20 μA), the first current limiting circuit 310 allows an equivalent amount of current to flow through transistor M7 in the same manner as described above and the current flowing through the second current limiting circuit 320 will be about 0 μA.

FIGS. 5*a* and 5*b* illustrate the operation of the circuit described above with reference to FIG. 3*b* in accordance with one embodiment of the present invention in which the input current is increasing. For illustrative purposes only, the operation of the circuit is discussed assuming the same current source values as discussed above with reference to FIGS. 4*a* and 4*b* to illustrate yet another curve that is attainable from one of the embodiments of the present invention.

In this example, the input current source I1 is assumed to be increasing from about 3 μA to about 30 μA as the input voltage increases. The output of the first current limiting circuit 310, i.e., the current flowing through transistor M7, will vary linearly with respect to the input current source I1 from 3 μA to a maximum of 20 μA (or as determined by constant current sources I2 and I3). The output current of the second current limiting circuit 320, i.e., the current flowing through transistor M9, will vary linearly from a maximum of about 7 μA to about 0 μA. Thus, the output current $I_{out}$ will increase linearly from 10 μA (the sum of 3 μA flowing through transistor M7 and 7 μA flowing through transistor M9) to 20 μA (the sum of 20 μA flowing through transistor M7 and 0 μA flowing through transistor M9). Accordingly, the output current $I_{out}$ is limited to a minimum of 10 μA when the input voltage is below $V_1$ and a maximum of 20 μA when the input voltage is above $V_2$ as illustrated in FIG. 5*b*.

FIGS. 6*a* and 6*b* illustrate the operation of the circuit described above with reference to FIG. 3*b* in accordance with one embodiment of the present invention in which a reverse output current curve $I_{out}$ with respect to the input voltage $V_{in}$ is obtained. In this situation, constant current sources I2 and I3 are configured as 10 μA current sources, and constant current source I4 is configured as a 20 μA current source.

Assuming the input current source is decreasing from about 30 μA to about 3 μA as the input voltage increases, the output of the first current limiting circuit 310, i.e., the current flowing through transistor M7, will varying linearly with respect to the input current source I1 from 10 μA (or as determined by constant current sources I2 and I3) to a minimum of about 3 μA. The current output of the second current limiting circuit 320, i.e., the current flowing through transistor M9, will vary inversely with respect to the input current source I1 from about 0 μA to about 17 μA. Thus, the output current $I_{out}$, which will be substantially equivalent to the sum, will increase linearly from 10 μA (the sum of 3 μA flowing through transistor M7 and 7 μA flowing through transistor M9) to 20 μA (the sum of 20 μA flowing through transistor M7 and 0 μA flowing through transistor M9) while the input current source is decreasing from about 30 μA to about 3 μA and while the input voltage increases from $V_1$ to $V_2$. Below $V_1$, the output current $I_{out}$ is clipped to a minimum of 10 μA, and above $V_2$, $I_{out}$ is clipped to a maximum of 20 μA.

FIGS. 7*a* and 7*b* illustrate that the reverse curve is obtainable when the input current source I1 is increasing from about 3 μA to about 30 μA as the input voltage increases, in accordance with one embodiment of the present invention. In this situation, the constant current sources I2, I3, and I4 are configured as 10 μA, 10 μA, and 20 μA current sources, respectively, as discussed above with reference to FIGS. 6*a* and 6*b*. Assuming the input current source is increasing from about 3 μA to about 30 μA, the output of the first current limiting circuit 310, i.e., the current flowing through transistor M7, will vary linearly with respect to the input current source I1 from 10 μA (or as determined by constant current sources I2 and I3) to a minimum of about 3 μA. The current output of the second current limiting circuit 320, i.e., the current flowing through transistor M9, will vary inversely with respect to the input current source I1 from about 17 μA to about 0 μA. Thus, the output current $I_{out}$ decreases linearly from 20 μA (the sum of 3 μA flowing through transistor M7 and 7 μA flowing through transistor M9) to 10 μA (the sum of 20 μA flowing through transistor M7 and 0 μA flowing through transistor M9) while the input current source is increasing from about 3 μA to about 30 μA and the input voltage increases from $V_1$ to $V_2$. Below $V_1$, $I_{out}$ is clipped to a maximum of 20 μA, and above $V_2$, $I_{out}$ is clipped to a minimum of 10 μA.

Figure 8:
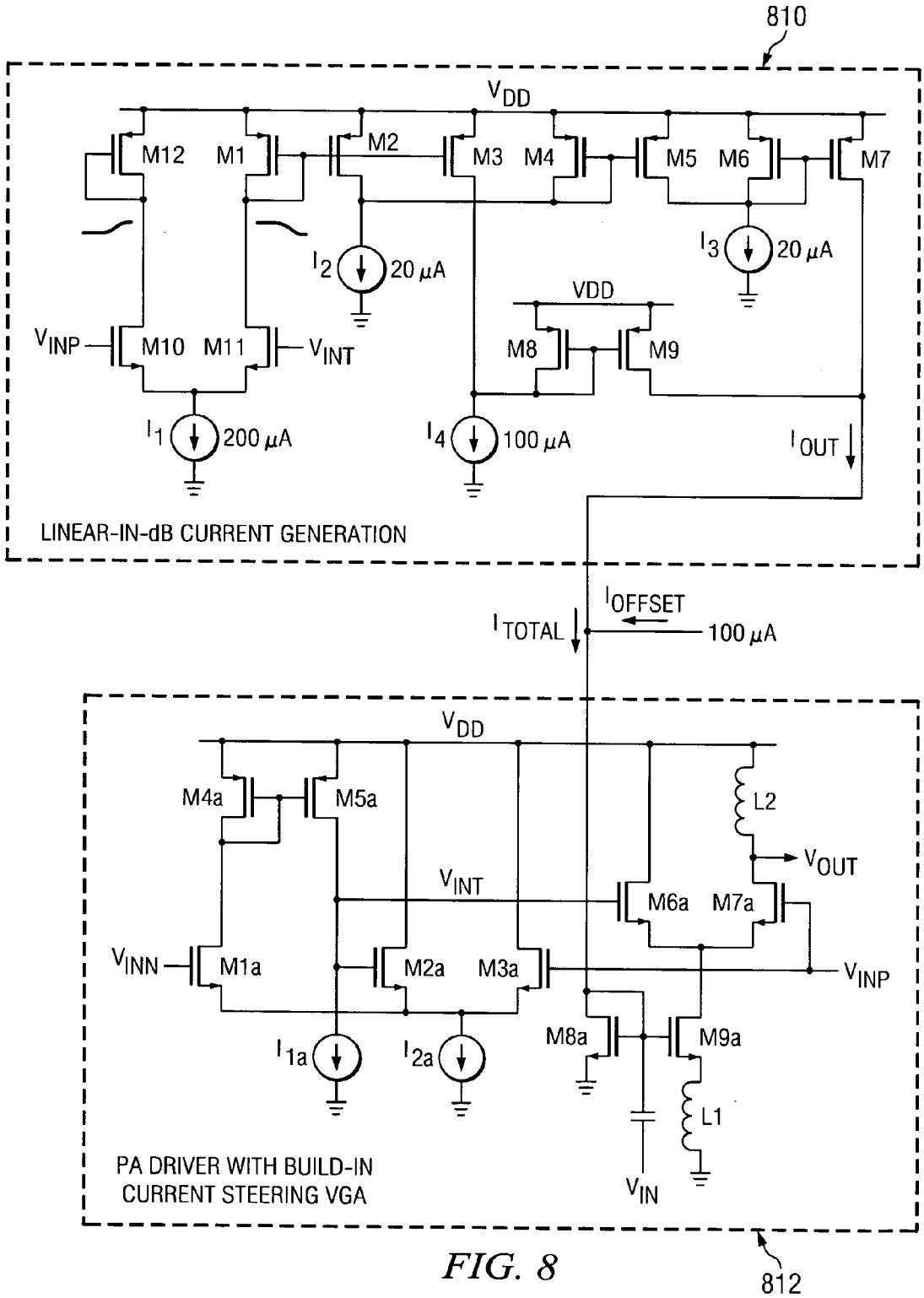
FIG. 8 is a circuit diagram of a linear-in-dB current generator and power amplifier in accordance with one embodiment of the present invention.

FIG. 8 is a circuit diagram of a linear-in-dB current generation and a power amplifier (PA) with built-in current steering VGA in accordance with one embodiment of the present invention. As discussed above, embodiments of the present invention may be designed to achieve various output current $I_{out}$ curves with respect to the input voltage levels. The resulting output current $I_{out}$ comprises a linear-in-dB bias with the ability to clip the output current $I_{out}$ at one or both ends of the range of output current $I_{out}$ values. The circuit diagram in FIG. 8 comprises a linear-in-dB current generator 810 and a PA driver with built-in current steering VGA 812. The circuit diagram for the PA driver 812 is provided for illustrative purposes only. Other circuits for the PA driver 812 may be used without varying the scope of the present invention.

The transistors may be MOSFET transistors working in weak inversion to resemble the characteristics of a bipolar transistor. Alternatively, other transistors, such as bipolar transistors and the like, may be used.

The linear-in-dB current generator 810 operates substantially as discussed above, except that the input current source I1 includes a fixed current source and three additional transistors (M10, M11, and M12). The input gates of transistors M10 and M11 are connected to $V_{inp}$ and $V_{int}$, respectively, wherein $V_{inp}$ is an input voltage, and $V_{int}$ is a feedback voltage.

In operation, the currents flowing through transistors M10 and M11 are exponentially increasing and decreasing, respectively, when the input control voltage $V_{inp}$ increases. The remaining circuitry of the linear-in-dB generator 810 operates substantially the same as described above with reference to FIGS. 4*a*–7*b*. Furthermore, the DC currents indicated for input current sources I1, I2, I3, and I4 are for illustrative purposes only and, as discussed above, may be varied to achieve a desired curve for a specific application or scenario.

The output current $I_{out}$ is summed with a current offset $I_{offset}$ to generate a total current $I_{total}$, which is provided as input to PA driver with a built-in current steering VGA. The point at which the final output current $I_{total}$ remains constant at maximum value is adjustable by changing the DC current through current sources I2 and I3. The constant minimum $I_{total}$ output current can be programmed by changing the DC value of current source I4 and the value of $I_{offset}$. This provides flexibility in the circuit design. By varying the final output current $I_{total}$ and limiting the maximum value of the final output current $I_{total}$, the amount of current dumped through the dumping transistor is reduced, thereby providing additional power savings.

Preferably, the bias current linear-in-dB for the PA driver with current reduction circuit is designed such that some power is dumped through the dumping transistor. This threshold voltage is dependent upon the PA design and the gain slope of the VGA. Due to the simple circuit technique used in this current reduction scheme, the constant minimum output current can easily be programmed to the desired values.

Although the present invention and its advantages have been described in detail, it should be understood that various changes, substitutions and alterations can be made herein without departing from the spirit and scope of the invention as defined by the appended claims. For example, all specific current and voltage values could be varied to fit the requirements of a specific application. Also one of ordinary skill in the art may modify the circuits by switching NMOS for PMOS and vice-versa.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A current generator providing an output current comprising:

an input mirror having a first current source, a second current source, a first transistor, and a second transistor, the first current source being a variable input current source, the first transistor outputting a first mirror current source of the variable current source limited by the first current source, and the second transistor outputting a second mirror current source of the variable current source limited by the second current source;

a first current limiter having a third current source and one or more transistors, the first current limiter coupled to the first transistor of the input mirror and having a third transistor outputting a first current output substantially equivalent to the variable input current source limited by the third current source;

a second current limiter having a fourth current source and one or more transistors, the second current limiter coupled to the second transistor of the input mirror and having a fourth transistor outputting a second current substantially equivalent to the first current source limited by the second current source; and a node coupled to the first current limiter and the second current limiter wherein the output current is the sum of the first current and the second current.

2. The current generator of claim 1 wherein the second current source is substantially equivalent to the third current source.

3. The current generator of claim 1 wherein the current generator is coupled to a power amplifier driver.

4. The current generator of claim 3 wherein an offset is added to the output of the current generator.

5. The current generator of claim 1 wherein the second and third current sources generate substantially equal currents and are less than the fourth current source.

6. The current generator of claim 1 wherein the second and third current sources generate substantially equal currents and are greater than the fourth current source.

7. The current generator of claim 1 wherein the second current source is programmable.

8. The current generator of claim 1 wherein the third current source is programmable.

9. The current generator of claim 1 wherein the fourth current source is programmable.

10. A current generator providing an output current comprising:

an input circuit having a first current source, a second current source, a first transistor, and a second transistor, the input circuit coupled to a positive input voltage and a voltage feedback, current flowing through the first transistor changing exponentially in inverse relation to the positive input voltage and limited by the second current source;

the first current source being a variable current source and the second current source being a constant current source, the first transistor and the second transistor outputting a mirror current of the variable current source with respect to the second current source;

a first current limiter having a third constant current source and one or more transistors, the first current limiter coupled to the first transistor of the input mirror and having a third transistor outputting a first current output substantially equivalent to the variable input current source clipped at the current level defined by the second constant current source;

a second current limiter having a third constant current source and one or more transistors, the first current limiter coupled to the first transistor of the input mirror and having a third transistor outputting a first current output substantially equivalent to the variable input current source clipped at the current level defined by the second constant current source; and a node coupled to the output of the first current limiter and the output of the second current limiter, outputting a linear-in-dB current.

11. The current generator of claim 10 wherein the second current source is substantially equivalent to the third current source.

12. The current generator of claim 10 wherein the current generator is coupled to a power amplifier driver.

13. The current generator of claim 12 wherein an offset is added to the output of the current generator.

14. The current generator of claim 10 wherein the second and third current sources generate substantially equal currents and are less than the fourth current source.

15. The current generator of claim 10 wherein the second and third current sources generate substantially equal currents and are greater than the fourth current source.

16. The current generator of claim 10 wherein the second current source is programmable.

17. The current generator of claim 10 wherein the third current source is programmable.

18. The current generator of claim 10 wherein the fourth current source is programmable.

* * * * *